United States Patent [19]

Amezcua

[11] Patent Number: 4,756,336

[45] Date of Patent: Jul. 12, 1988

[54] STOVE CONTROL TIMER

[76] Inventor: Marco Amezcua, Privada del Crepusculo #36 Lote 22 Edificio A Departamento 103 Pedregal de Carrasco, Mexico City, Mexico, D. F. C. P. 04700

[21] Appl. No.: 54,018

[22] Filed: May 26, 1987

[51] Int. Cl.[4] ..... F23N 1/00

[52] U.S. Cl. ..... 137/624.12; 431/86

[58] Field of Search ..... 137/624.11, 624.12, 137/624.21, 624.22; 431/86

[56] References Cited

U.S. PATENT DOCUMENTS

| | | | |
|---|---|---|---|
| 186,672 | 1/1877 | Fryer | 137/624.22 |
| 1,624,168 | 4/1927 | Gschwind | 251/292 X |
| 2,373,189 | 4/1945 | Klein | 431/86 X |
| 3,180,358 | 4/1905 | Cogdell | 137/624.11 |
| 3,820,405 | 6/1974 | Hong | 137/624.22 X |

*Primary Examiner*—Alan Cohan

*Attorney, Agent, or Firm*—Julius Rubinstein

[57] ABSTRACT

A timer for attachment to a stove operated by manually controlled gas control knobs converts an ordinary manually operated stove to a timer controlled stove without requiring a technician to cut in to the gas lines of the stove. The timer includes a housing with a knob rotating shaft mounted in the housing. A knob gripper is mounted on the end of the knob rotating shaft for gripping the manually operated fuel control knob of the stove. A mechanism is mounted in the housing for rotating the knob rotating shaft. A timer is connected to the mechanism in such a way that if the knob gripper is gripping the fuel control knob, the mechanism rotates the fuel control knob through a predetermined angle, after a time delay determined by the setting of the timer. In this way if the fuel control knob of the stove is connected to a fuel valve shaft, rotation of the fuel control knob rotates the fuel valve shaft to limit the flow of fuel to the burner on the stove.

14 Claims, 3 Drawing Sheets

FIG. 1.
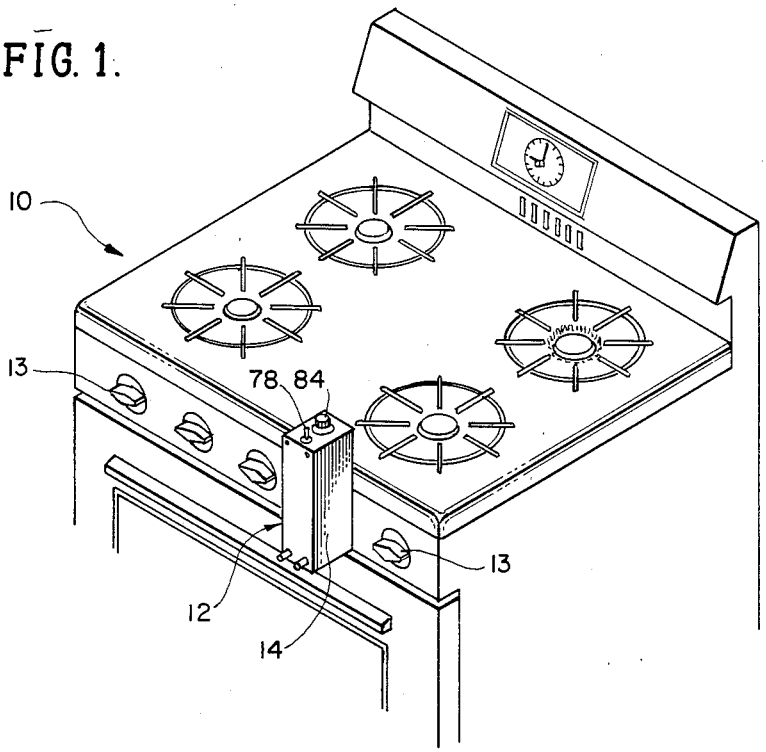
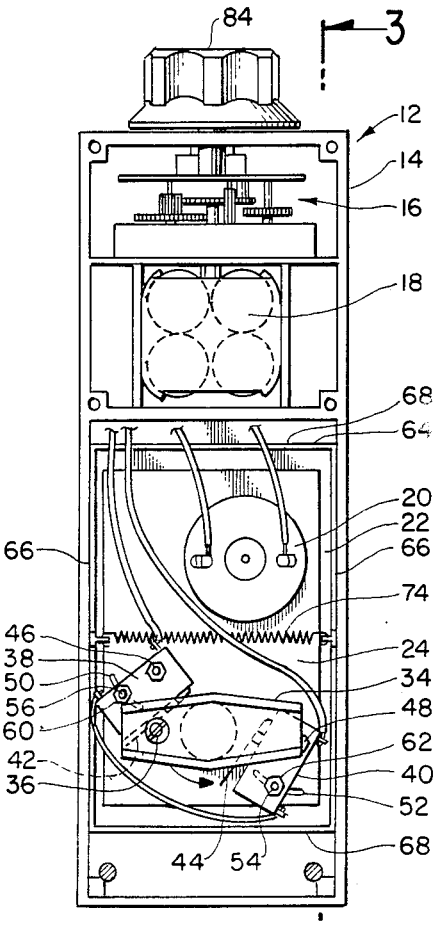
FIG. 2.
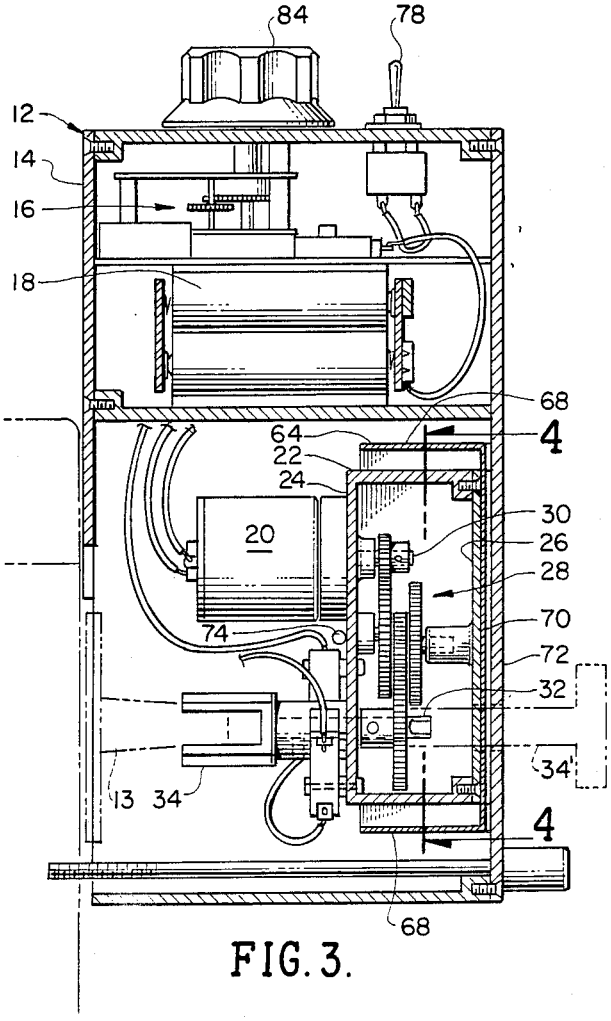
FIG. 3.

STOVE CONTROL TIMER

This invention relates to a stove control timer and more particularly to a stove control timer which can be attached to any stove without modification of the stove.

BACKGROUND AND BRIEF SUMMARY

In the past, timer actuated devices have been used to turn power (gas or electric) on or off of a stove. Prior timer controlled valve actuated devices used to turn on stoves, or control valves can be divided into three separate categories.

The first group of timer controlled valve actuating devices is exemplified by U.S. Pats. Nos. 2,626,661, 2,315,774, 2,019,008, and 2,302,624 by McDowell, Couzens, Hauser, and Gallagher.

These patents relate to a gas stove and utilize an auxiliary timer controlled gas control valve in combination with a manually operated gas control knob stove so that the stove can be operated conventionally by the use of the manual gas control knob, or in a timer controlled operation by using the auxiliary timer controlled gas control knob.

The second group of timer controlled valve actuating devices is exemplified by the U.S. Pats. Nos. 3,894,557, 3,820,405, and 3,595,273, by Impett, Hong, and Kolodziej. These patents are characterized by mounting a timing mechanism inside a control knob attached to a gas control valve in the stove.

The third group of timer controlled valve actuating devices is exemplified by the U.S. Pats. Nos. 3,803,923, and 4,090,532 by Hajny and Story Jr. These patents are not specially designed for stoves but they illustrate various ways valves can be time controlled.

Some stoves have the features described in the above identified first and second groups of patents built into the stove so that the burners on these stoves can be manually or time controlled. However many stoves, particularly older, less expensive stoves do not. Previously attachments such as those described in the first and second groups of patents have been made for connection to older stoves to provide them with a timer controlled function. However, when adding this feature to a stove, particularly the features described in the first and second groups of patents described above, a technician was required to open the gas lines in the stove. This need for a technician to modify the gas lines of the stove was expensive.

Moreover, persons on camping trips or traveling in mobile homes often use small stoves powered by propane or kerosene, and they are inconvenienced because such stoves do not have a timer control.

It is apparent that it would be desireable to have a timer controlled stove operating device, so that persons using any stove, even small propane or kerosene powered stoves such as those used on camping trips may have the convenience of a timer controlled stove, and to provide such a timer controlled stove comprises an important object of this invention.

This and other objects of this invention will become more apparent when better understood in the light of the accompanying specification and drawings wherein:

FIG. 1 is a perspective view of the timer actuated gas control unit attached to a stove.

FIG. 2 is an elevational view of the timer actuated gas control unit shown in FIG. 1 with a wall removed to disclose the interior of the unit.

FIG. 3 is a sectional view taken on the line 3—3 of FIG. 2.

Figure 7:
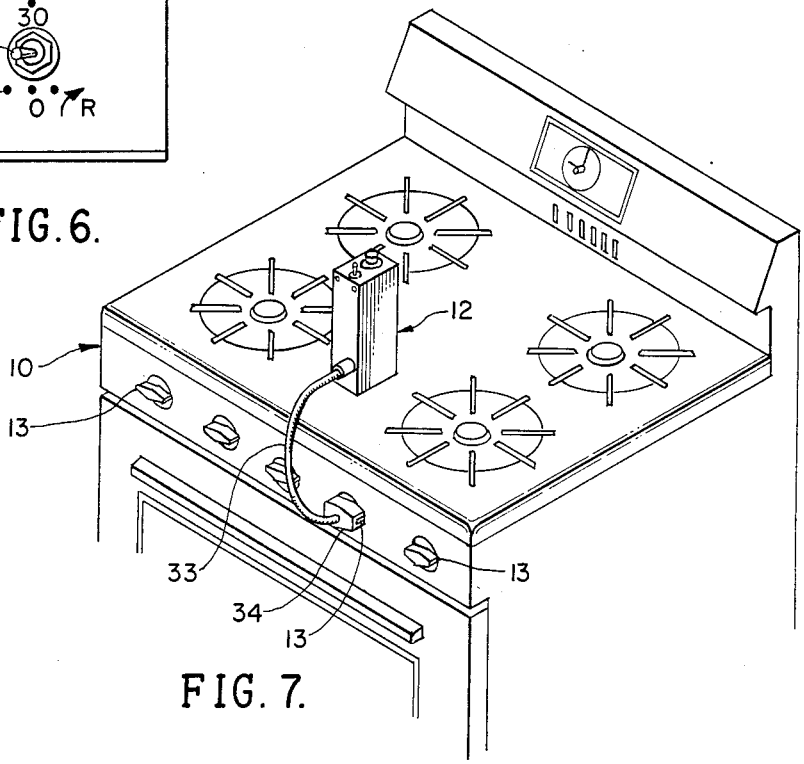

FIG. 7 discloses an alternate embodiment of the timer actuated gas control unit, wherein the timer actuated gas control unit is mounted on the top of the stove and is connected to the gas control knobs of the stove through a flexible rotary drive shaft.

Figure 8:
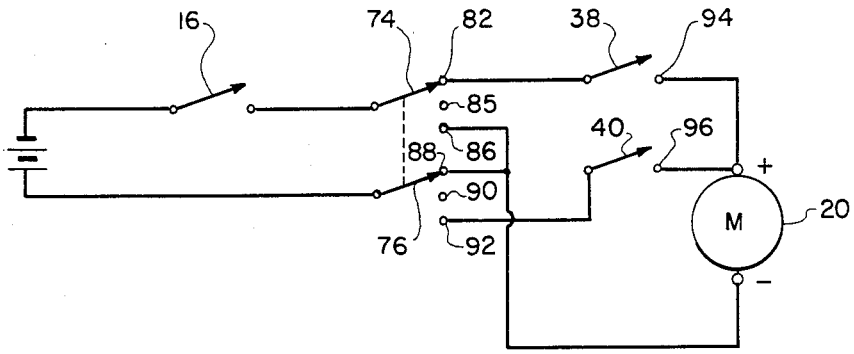

FIG. 8 discloses a battery powered control circuit set in one position for causing the motor in the timer actuated gas control unit to rotate in one direction.

Figure 9:
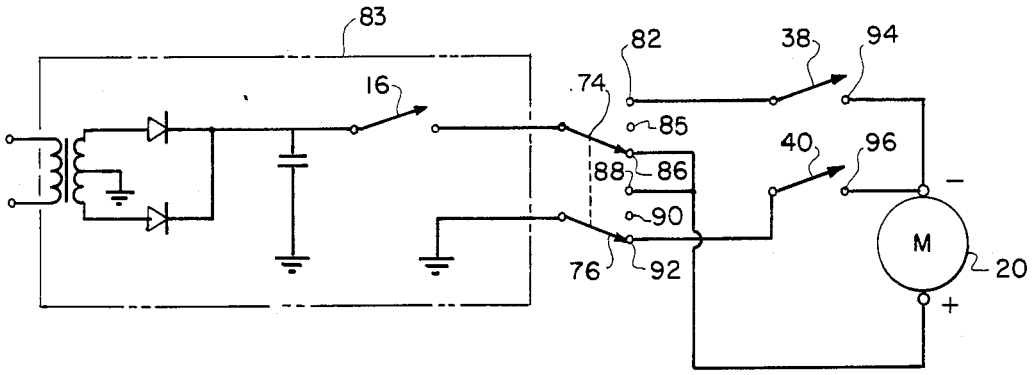

FIG. 9 discloses the circuit shown in FIG. 8 but set in another position so the rotation of the motor in the timer actuated gas control unit is in the opposite direction. but modified so it is powered by ordinary house voltage.

Referring now to FIG. 1 of the drawing, a simple conventional four burner gas stove 10 is disclosed. A timer actuated gas gas control unit 12 is removably attached to one of the gas control knobs 13 on the stove 10 by any suitable means. The gas control unit 12 is mounted inside a housing 14 which may be formed from magnetic material which can adhere to the metal body of the stove. A conventional timer switch 16, which in this embodiment is mechanical, although an electrical or solid state timer is also contemplated, is mounted inside the housing 12.

As an alternative, if the stove has an electric clock with an alarm built in, to indicate the time and to sound an alarm when the cooking time has been completed, see FIG. 1, the electric clock may be connected to the gas control unit to serve as the timer for the gas control unit.

In the embodiment shown in FIGS. 2 and 3, the gas control unit 12 is powered by batteries 18 so that the timer actuated gas control unit may be attached to small propane or kerosene stoves for use on camping trips. It is also apparent that the gas control unit 12 could be powered by ordinary house voltage instead of batteries, see FIG. 9.

An electric motor 20 is attached to a resiliently mounted box-like support 22 which includes a top support wall 24 and a bottom support 26 on which a transmission 28 is mounted. The transmission 28, in this particular embodiment, comprises a genrally conventional gear chain, but other transmissions may be used.

The motor shaft 30 is connected to a knob rotating shaft 32 through the transmission 28. In this way, operation of motor 20 rotates the knob rotating shaft 32.

A knob gripper 34 is rigidly mounted on the end of the knob rotating shaft 32 for attachment to the gas control knob 13. Although no adjustments as shown on the knob gripper 34, it is contemplated that the knob gripper could have various shapes and adjusting devices secured to it so it could grip differently shaped operating knobs 13. With this arrangement operation of the motor 20, would rotate the gas control knob 13.

In summary to this point, when the timer switch 16 closes, the motor 20 is started and this turns the motor drive shaft 30. This in turn, through transmission 28, rotates the knob rotating shaft 32. If the knob gripper 34 is attached to the stove control knob 13, the stove burner would turn off when the shaft 32 rotates.

Figure 5:
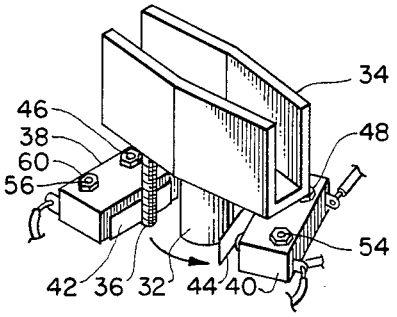
FIG. 5 is a perspective view of the knob rotating shaft, the knob gripper, and the limit switches associated with the switch actuating post.

As shown in FIG. 5, a switch actuating post 36 is attached to the knob gripper 34 and extends in radially outwardly spaced parallel relationship to the axis of the knob rotating shaft 32. A pair of limit switches 38 and 40 are movably mounted on the support wall 24 for reasons to be described below, see FIG. 3. Switch actuating blades 42 and 44 are mechanically associated with limit switches 38 and 40 in such a way that when the switch actuating blades are pressed against the associated limit switch, the contacts in the limit switch open.

For reasons to be explained below, the limit switches are pivotally mounted on the support wall 24 by means of pivot pins 46 and 48. Arcuate slots 50 and 52 are formed in the support wall. Guide pins 54 and 56 secured to and depending from the limit switches 38 and 40, extend through the arcuate slots 50 and 52. With this arrangement, the limit switches can rotate on the pivot pins 46 and 48 over the surface of the support wall 24 to vary the angular distance between the switch actuating blades 42 and 44 for reasons to be described below. Locking nuts 60 and 62 are secured to the guide pins to fix the limit switches in any desired angularly spaced relationship.

Referring again to FIG. 1 of the drawings, the gas control knobs 13 are each secured to a gas valve shaft (not shown), which control the amount of gas flowing to the burners in the stove. These gas control knobs are quickly and cheaply made. As a consequence they may not be completely concentric with the axis of the gas valve shaft. Under these circumstances when the knob 13 is rotated, the lack of concentricity between the gas control knob 13 and the axis of the associated gas valve shaft would cause the gas control knob 13 to shift in a plane transverse to axis of the gas valve shaft. For this reason the mechanism for rotating the gas control knob must be resiliently mounted. If the connection between the knob gripper 34 and the gas control knob 13 were not resilient, the shift in position of the gas control knob 13 as it is rotated would cause the mechanism driving the gas control knob 13 to jam.

As shown in FIG. 2, this problem is solved by resiliently mounting the entire mechanism attached to the gas control knob 13 inside the housing 14 of the gas control unit 12. In particular as shown in FIGS. 2 and 3, the mechanism is mounted on the generally box-like support 22, see FIGS. 2, 3, and 4. The box-like support 22 is positioned inside a generally box-like retainer structure 64 comprising side and end walls 66 and 68 and an integrally attached base wall 70 which is rigidly secured to the wall 72 of the housing 14, see FIG. 3. A coil spring 74, is attached to the upper edges of the side walls 66 and passes over the support wall 24, see FIG. 2. With this arrangement, the entire mechanism, including the motor 20, the transmission 28, the knob drive shaft 32 and the knob gripper 34 is resiliently mounted as a unit in the retainer structure 64 to accommodate any displacement of the gas control knob 13 due to a lack of concentricity with the axis of the gas valve shaft.

As an alternative to this arrangement, the gripper 34 may be secured to the end of the knob drive shaft by a universal joint, (not shown), which would be designed to give the knob gripper 34 some limited pivotal movement to accommodate any lack of concentricity between the axis of the gas valve shaft and the gas control knob 13. Other means for accommodating the gripper to this lack of concentricity between the stove control knob and the gas valve shaft are contemplated.

In the embodiment shown in FIG. 1, the housing 14 of the gas control unit 12 must be firmly attached to the stove during operation of the gas control unit 12. Depending on the structure of the stove, this could pose difficult problems.

As an alternative to the embodiment shown in FIG. 1, the base of the housing 14 of the gas control unit 12 could be removably mounted on top of the stove by making the base of the housing 14 magnetic so it strongly adheres to the metal on top of the stove, see FIG. 7. In this alternate embodiment, the end of the knob drive shaft 32 is connected to one end of a flexible rotary drive shaft 33. The knob gripper 34 is secured to the other end of the flexible drive shaft 33, and in use, the knob gripper 34 would be attached to the gas control knob 13. With this arrangement rotation of the knob drive shaft 34 would cause the gas control knob 13 to rotate. This requires the switch actuating post 36 to be attached to the knob drive shaft 32 instead of to the gripper 34.

As stated above the contacts in the limit switches 38 and 40 open when their associated switch actuating blades 42 and 44 are pressed against the body of the switch. This happens when the motor 20 causes the knob drive shaft 32 to rotate, causing the switch actuating post 36 to move into engagement with one of the switch actuating blades. The switch actuating blade engaged by the switch actuating post 34 depends on the direction of rotation of the knob drive shaft 32. In particular, as shown in FIG. 5, the switch actuating post 36 has moved into engagement with the switch actuating blade 42 causing limit switch 38 to open which stops further rotation of the motor 20 for reasons to become apparent below.

Figure 6:
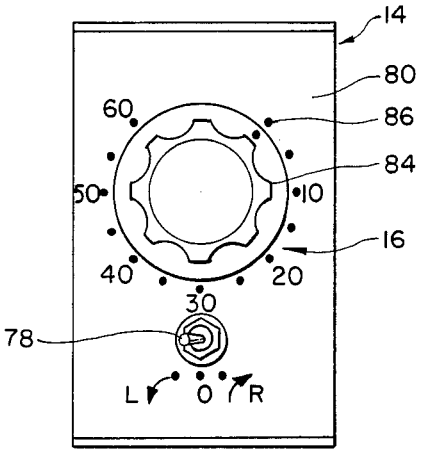
FIG. 6 is a front view of the time control knob and the switch lever.

A two blade three position switch 70 mounted inside the housing 14 of the gas control unit 12, has a control lever 78 mounted on the outside wall 80 of the housing 14, see FIG. 6. The switch 70 comprises blades 74 and 76 and these are controlled by the switch lever 78.

Referring to FIG. 8, blade 74 is movable between terminals 82, 85, and 86, while blade 76 is movable between terminals 88, 90 and 92. Blades 74 and 76 are tied together mechanically so they move in unison when actuated by operation of the switch lever 78. In particular when post 36 engages blade 42, as shown in FIG. 5, the limit switch 38 moves to the open position shown in FIG. 8, while the contacts in limit switch 40 remain in the closed position.

In the circuit shown in FIG. 9, the polarity of the motor is as indicated in the circuit diagram. For convenience this will be referred to as the left rotation mode, and this is indicated by the indicia "L" associated with the left position of the switch lever 78. When the switch lever 78 is in the position shown in FIG. 6, switch blades 74 and 76 engage terminals 86 and 92. When the switch lever 78 is moved to the opposite position by the indicia "L" associated with the left position of the switch lever 78. When the switch lever 78 is in the position shown in FIG. 6, switch blades 74 and 76 engage terminals 86 and 92. When the switch lever 78 is moved to the opposite position by the indicia "R" the switch blades 74 and 76 move to the position shown in FIG. 8 and engage the terminals 82 and 88. As will become apparent by inspecting the circuit diagrams shown in FIGS. 8 and 9, this changes the polarity of the motor to what for convenience will be referred to as the right rotation mode.

In summary to this point when the switch lever 78 is in the position by the indicia "L", and the switch actuating post 36 is pressed against switch actuating blade 42, the limit switch 38 opens. Then when the timing mechanism times out closing the timer switch 16, a circuit is completed through the motor 20 causing the motor shaft 30 to rotate. The motor shaft rotates the knob drive shaft 32 through the transmission 28. This rotation continues until the switch actuating post 36 engages the switch actuating blade 44 associated with the limit switch 40 causing the limit switch 40 to open thereby breaking the circuit and stopping the motor. If the knob gripper 34 were connected to the gas control knob 13, the rotation of the knob drive shaft 32 would cause the stove control knob 13 to rotate and turn the gas off.

If the switch lever 78 is moved to the position by the indicia "R", the switch blades 74 and 76 engage terminals 82 and 88. If at that time the switch actuating post 36 is in engagement with the switch actuating blade 44, limit switch 40 would be in the open position while limit switch 38 would be in the closed position. In this way when the timer switch 16 times out and closes, a circuit is completed through the motor 20 causing the motor to operate and rotate the knob drive shaft 32 in a direction opposite to the direction described above. This is because the circuit has reversed the polarity at the terminals of the motor 20. This ability to reverse motor rotation is important because stoves are constructed differently and some may require the gas control knob 13 to rotate in one direction to close, and other stoves might require the gas control knob to rotate in the opposite direction to close.

The switch lever 78 has a third position by the indicia "O". In this position the blades 74 and 76 engage the open terminals 84 and 90. This turns the gas control unit off.

The magnitude of the angular rotation of the gas control knob required to turn the gas control knob 13 enough so the flow of gas or kerosene to the stove burner is completely shut off may vary from stove to stove. This requires an adjustment of the angular spacing between limit switches 38 and 40. To make this adjustment, the lock nuts 58 and 60 shown in FIG. 2 must be loosened. Next the limit switches 38 and 40 must be rotated on pivot pins 46 and 48, until the magnitude of the rotation of the knob drive shaft 32 required to bring the switch actuating post 36 into engagement with one of the switch actuating blades coincides with the magnitude of the rotation of the gas control knob required to cut off the flow of gas or kerosene to the burner of the stove. Then then the lock nuts must be tightened to keep the limit switches in the proper position.

Under some circumstances it may be desired to only reduce the magnitude of the gas flame in the burner after a predetermined period of time, and not completely shut the burner off. This would require the angular separation between the limit switches 38 and 40 to be adjusted so that the switch actuating post 36 engages a switch actuating blade when the knob rotating shaft has rotated the gas control knob 13 enough to reduce the gas flame on the burner of the stove to the extent required.

Figure 4:
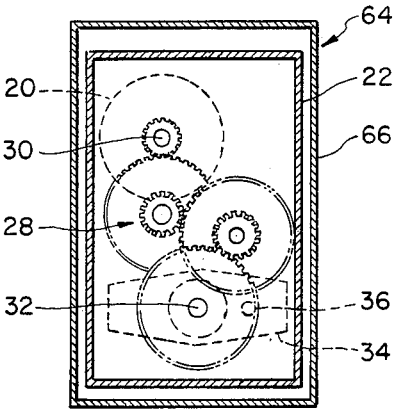
FIG. 4 is a sectional view taken on the line 4—4 of FIG. 3.

The lock nuts 60 and 62 which are threaded onto guide pins 54 and 56 shown in FIGS. 3 and 4 are inconveniently mounted if the intention is to make frequent changes in the magnitude of the reduction of the gas flame on the burner of the stove.

If frequent adjustments are required, the guide pins 54 and 56 would be made long enough to extend through wall 72. Arcuate slots parallel to slots 52 and 54 would be formed in wall 72 through which the guide pins 54 and 56 would extend. The locking nuts 60 and 62 would be threaded onto the end of the guide pins 54 and 60 on the outer surface of wall 72 and would function to lock the limit switches in the desired angular position. Suitable indicia would be formed by the arcuate slots to provide a convenient way to adjust the rotation of the gas control knob 13 to control the magnitude of the decrease in the size of the gas flame.

The timer actuated gas control unit 12 shown in FIG. 2, is powered by the house voltage as shown by the circuit of Fig. 9. In this circuit the batteries 18 have been replaced by a conventional rectifier circuit 83 in the area encompassed within the phantom lines. In all other respects the circuit shown in FIG. 9 is the same as the circuit shown in FIGS. 8.

A timer control knob 84 is mounted on thehousing wall 80 and is attached to the timing mechanism inside the housing 14 in such a way that the rotation of the knob 84 past the indicia 86 on the wall 80 causes the timing mechanism to close switch 16 at the time indicated by the position of the pointer of knob 84 by the indicia 86 when the timer is actuated.

After the gas control unit 12 has functioned and has rotated the gas control knob 13 to a position either completely off or to a partially closed position, the gas control unit must be reset before it can be used again. To do this, a reset knob 34' is connected to the end of the knob rotating shaft 32 opposite the knob griper 34, extending through the wall 72. This is shown in phantom lines in FIG. 3. With this arrangement, after the gas control unit 12 has, for example, rotated the gas control knob 13 so the gas is turned off, the gas control knob 13 can be rotated to a gas on position by manually rotating the reset knob 13' without removing the connection of the gas control unit 12 with the stove. As a result, the gas control unit 12 may remain permanently attached to the stove without interfering with the operation of the stove.

Although the control unit 12 has been described in connection with the control of a gas or kerosene type stove, it is contemplated this unit could be used to provide a timer controlled attachment for other kinds of devices which have a manually operated control knob.

Having described the invention what I claim as new is:

1. A timer actuated stove control for direct attachment to a manually operated fuel control knob on a fluid fueled stove of the kind wherein adjustment of the fuel control knob continuously adjusts the size of the flame on the stove for converting the manually operated fuel control knob to a timer controlled fuel control knob which can continuously adjust the size of the flame on the stove to any predetermined level at a time determined by the setting of the timer, comprising a housing, a knob rotating shaft rotatably mounted in the housing, a knob gripper attached to the end of said knob rotating shaft for gripping the manually operated fuel control knob on the stove, a mechanism in said housing connected to said knob rotating shaft for rotating said shaft, said mechanism having adjustment means for controlling the magnitude of the rotation of said shaft to control the size of the flame on said stove, a timer connected to said mechanism in such a way that if said knob gripper is gripping the fuel control knob on the stove, said mechanism rotates said fuel control knob through an angle determined by the setting of said adjustment means after a time delay determined by the setting of the timer to control the size of the flame on the stove.

2. The timer actuated stove control described in claim 1 wherein said knob gripper is adjustable to accomodate any lack of concentricity between the fuel control knob and the axis of the fuel valve shaft controlled by rotation of said fuel control knob.

3. The timer actuated stove control described in claim 1 wherein said knob gripper is resiliently mounted in said housing to accomodate any lack of concentricity between the fuel control knob and the axis of the valve shaft controlled by rotation of said fuel control knob.

4. The timer actuated stove control described in claim 1 wherein said mechanism includes a reversible electric motor and a transmission connected between said motor and said knob rotating shaft and in such a way that operation of said motor causes said knob rotating shaft to rotate, a control circuit mounted in said housing and actuated by said timer for turning the motor on and controlling its direction of rotation, the motor, the transmission, the knob rotating shaft and the knob gripper resiliently mounted as a unit in the housing to permit the knob gripper when gripping the fuel control knob to accomodate any lack of concentricity between the fuel control knob and the axis of the valve shaft controlled by said fuel control knob.

5. The timer actuated stove control described in claim 1 wherein said mechanism includes a reversible electric motor for rotating said knob rotating shaft, a battery powered control circuit mounted in the housing and actuated by said timer for running the motor and controlling its direction of rotation.

6. The timer actuated stove control described in claim 4 wherein said control circuit is battery powered so the timer actuated stove control can be used with simple propane or kerosene stoves in the field.

7. The timer actuated stove control described in claim 1 including adjustably positioned limit means associated with said knob rotating shaft for controlling the angle of rotation of the knob rotating shaft so that the size of the flame on the stove can be continuously adjusted after a time delay determined by the setting of the timer actuated stove control.

8. The timer actuated stove control described in claim 7 wherein said limit means comprises a limit switch mounted in the housing, means associated with said knob rotating shaft for engaging said limit switch after said rotating shaft has been rotated through said angle of rotation, and means connecting said limit switch to said mechanism for stopping further rotation of the knob rotating shaft after said means engages said limit switch.

9. The timer actuated stove control described in claim 7 wherein said limit means comprises limit switches mounted in said housing in spaced relationship to each other, means associated with said knob rotating shaft for engaging one of said limit switches, after said rotating shaft has been rotated through said angle or rotation, and means connecting said limit switches to said mechanism for stopping further rotation of the knob rotating shaft after said means engages one of said limit switches.

10. A timer actuated stove control for direct attachment to a manually operated fuel control knob on a fluid fueled stove of the kind wherein adjustment of the fuel control knob continuously adjusts the size of the flame on the stove for converting the manually operated fuel control knob to a timer controlled fuel control knob which can continuously adjust the size of the flame on the stove to any predetermined level, comprising a housing, a knob rotating shaft rotatably mounted in the housing, a knob gripper attached to the end of said knob rotating shaft for gripping the manually operated fuel control knob on the stove, a mechanism in said housing connected to said knob rotating shaft for rotating said shaft after a time delay determined by the setting of the timer actuated stove control, limit switches mounted in the housing, each limit switch having a switch actuating blade positioned in said housing in adjustable angularly spaced relationship to each other adjacent said knob rotating shaft so there is an adjustably set predetermined angle between said switch actuating blades, a switch actuator associated with said knob rotating shaft and positioned so it engages one of said switch actuating blades after said rotating shaft has been rotated through said predetermined angle, and means connecting said limit switches to said mechanism for stopping further rotation of said knob rotating shaft after said switch actuator engages a limit switch positioned in accordance with the desired flame size on the stove, whereby if said manually operated fuel control knob is connected to said fuel valve shaft and is gripped by said knob gripper, rotation of said fuel control knob through said predetermined angle by said knob rotating shaft after said time delay, rotates said fuel valve shaft to adjust the size of the flame in said stove in accordance with the rotational angle determined by position of said limit switches.

11. A timer actuated stove control for direct attachment to a manually operated fuel control knob on a fluid fueled stove to convert the stove from manual operation to a timer controlled operation comprising a housing, a knob rotating shaft rotatably mounted in the housing, a knob gripper attached to said knob rotating shaft for gripping the fuel control knob on a stove, a mechanism in said housing connected to said knob rotating shaft for rotating said shaft, a timer connected to said mechanism in such a way that if said knob gripper is gripping the fuel control knob, said mechanism rotates said fuel control knob through a predetermined angle after a time delay determined by the setting of the timer whereby if said fuel control knob is connected to a fuel valve shaft, rotation of said fuel control knob rotates said fuel valve shaft to limit the flow of fuel to a burner on a stove, and limit means associated with said knob rotating shaft for limiting the angle of rotation of the knob rotating shaft to a function of said predetermined angle of the stove control knob after said time delay, said limit means comprising limit switches mounted in said housing in spaced relationship to each other, means associated with said knob rotating shaft for engaging one of said limit switches after said rotating shaft has been rotated through said angle of rotation, and means connected to said limit switches to said mechanism for stopping further rotation of the knob rotating shaft after said means engages one of said limit switches, each limit switch having a switch actuating blade, said switch actuating blades mounted in angularly spaced relationship to each other, a switch actuator mounted in fixed relationship to said knob rotating shaft and rotatable therewith, said switch actuating blades positioned in such a way that when said knob rotating shaft is rotated said switch actuator engages one of said switch actuating blades thereby stopping further rotation of said knob rotating shaft.

12. The timer actuated stove control described in claim 11 including shaft reversing means connected to said knob rotating shaft for reversing the direction of rotation of said knob rotating shaft in order to adjusting the timer actuated stove control so it rotates said gas control knob in the angular direction required to decrease or turn off the flow of fuel to the burners of the stove.

13. The timer actuated stove control described in claim 11 wherein said switch actuating blades are mounted in said housing in such a way that the angular spacing between said switch actuating blades can be varied so that after said time delay, the knob rotating shaft rotates only until said fuel control knob has been rotated through said predetermined angle.

14. The timer actuated stove control described in claim 11 wherein said switch actuated blades are mounted in said housing in such a way that the angular spacing between them can be varied in such a way that said switch actuator engages one of said switch actuating blades to stop further rotation of said knob rotating shaft when said fuel control knob has been rotated through said predetermined angle.

* * * * *